US007390172B2

(12) United States Patent
Winkler

(10) Patent No.: US 7,390,172 B2
(45) Date of Patent: Jun. 24, 2008

(54) ASSEMBLY USED FOR COOLING A CIRCUIT BOARD OR SIMILAR

(75) Inventor: Wolfgang Arno Winkler, St. Georgen (DE)

(73) Assignee: EBM-PAPST St. Georgen GmbH & Co. KG, St. Georgen (DE)

( * ) Notice: Subject to any disclaimer, the term of this patent is extended or adjusted under 35 U.S.C. 154(b) by 50 days.

(21) Appl. No.: 10/574,988

(22) PCT Filed: Oct. 4, 2005

(86) PCT No.: PCT/EP2005/010652

§ 371 (c)(1),
(2), (4) Date: Apr. 6, 2006

(87) PCT Pub. No.: WO2006/042635

PCT Pub. Date: Apr. 27, 2006

(65) Prior Publication Data

US 2006/0228237 A1 Oct. 12, 2006

(30) Foreign Application Priority Data

Oct. 19, 2004 (DE) ..... 20 2004 019 747 U
Sep. 19, 2005 (DE) ..... 20 2005 015 079 U

(51) Int. Cl.
*F04B 17/03* (2006.01)
*H05K 7/20* (2006.01)

(52) U.S. Cl. ..... 417/423.15; 417/423.14; 361/697

(58) Field of Classification Search ..... 417/423.1, 417/423.15, 423.14; 361/697
See application file for complete search history.

(56) References Cited

U.S. PATENT DOCUMENTS

| | | | | |
|---|---|---|---|---|
| 4,885,488 | A | 12/1989 | Cox | 310/68 R |
| 5,478,221 | A | 12/1995 | Loya | 417/313 |
| 5,975,194 | A | 11/1999 | Wagner | 165/80.3 |
| 5,990,582 | A | 11/1999 | Henderson et al. | 307/139 |
| 6,013,966 | A | 1/2000 | Fehrenbacher et al. | 310/257 |
| 6,130,820 | A | 10/2000 | Konstad et al. | 361/695 |
| 6,174,232 | B1 | 1/2001 | Stoll et al. | 454/184 |
| 6,196,300 | B1 | 3/2001 | Checchetti | 165/80.3 |
| 6,498,724 | B1 | 12/2002 | Chien | 361/687 |
| 6,726,455 | B2 * | 4/2004 | Horng et al. | 417/14 |
| 2004/0100768 | A1 * | 5/2004 | Chen et al. | 361/697 |

FOREIGN PATENT DOCUMENTS

| | | |
|---|---|---|
| DE | 43 44 054 A1 | 6/1995 |
| DE | 195 03 521 A1 | 8/1995 |
| DE | 198 04 255 A1 | 8/1999 |
| EP | 0 666 424 A1 | 8/1995 |
| WO | WO 99-07196 | 2/1999 |
| WO | WO 02-071822 A1 | 9/2002 |

* cited by examiner

*Primary Examiner*—Charles G Freay
(74) *Attorney, Agent, or Firm*—Milton Oliver, Esq.; Ware, Fressola, van der Slyus & Adolphson, LLP

(57) ABSTRACT

A carrier frame (104), for installation on a circuit board (2), is implemented in the manner of an oil-drilling rig and comprises a platform (117) that is equipped with supporting legs (105, 106, 107, 108) for mounting on the circuit board (2). The carrier frame has, at the center of its platform (117), a depression (121, 123) that is implemented for installation of a fan (3) at a distance from the circuit board (2), the outer wall (123) of the depression (121, 123) forming part of the fan.

28 Claims, 12 Drawing Sheets

ASSEMBLY USED FOR COOLING A CIRCUIT BOARD OR SIMILAR

CROSS-REFERENCE

This application is a section 371 of PCT/EP2005/010652 filed 4 OCT. 2005.

FIELD OF THE INVENTION

The invention relates to an arrangement for cooling a circuit board or the like.

BACKGROUND

It is known to cool directly, by means of miniature and subminiature fans, regions of a circuit board at which a great deal of heat is generated. Such regions are usually referred to as "hot spots."

A disadvantage in this context is that the area on which such a fan is installed is no longer available for components, as indicated by DE 195 03 521 A1, AMRHEIN et al. It is also disadvantageous that the cooling air flow generated by usual miniature fans is poorly suited, because of its shape, for direct cooling close to the surface on circuit boards.

SUMMARY OF THE INVENTION

It is therefore an object of the invention to furnish a new arrangement for cooling a circuit board or the like.

According to the invention, this object is achieved by an arrangement including a fan mounted on a carrier frame, and associated with an air-directing element, for cooling a circuit board. In this context, a carrier frame is provided on which a miniature or subminiature fan is mounted, and provided on this carrier frame is an air-directing element which serves to deflect the flow direction of at least a portion of the air transported, during operation, through the air passage aperture. The result is to generate an air flow that is particularly suitable for cooling a circuit board; and it is also possible to arrange components on the circuit board below such an arrangement, and to cool them with the arrangement. Components generating a great deal of heat can, for example, be arranged directly at the fan in the strongest air flow. The latter can be directed either toward the circuit board, or away from it in order to extract hot air from the circuit board.

Another manner according to the present invention of achieving the stated object is a structure in which a support member is spaced above the circuit board and supports a fan whose output air is directed by an air-directing element. A carrier frame of this kind can itself form part of the fan, holds it at a distance from a circuit board that is to be cooled, and also directs the air flow generated by the fan in the desired direction.

Another manner of achieving the stated object is to employ a carrier frame shaped like an offshore oil drilling ring, having a platform configured with a depression for installation of the cooling fan. A carrier frame of this kind can be installed easily and in foolproof fashion, and is mounted in very stable fashion on the circuit board after being installed.

Further details and advantageous refinements of the invention are evident from the exemplifying embodiments, in no way to be understood as a limitation of the invention, that are described below and depicted in the drawings.

BRIEF FIGURE DESCRIPTION

Figure 24:
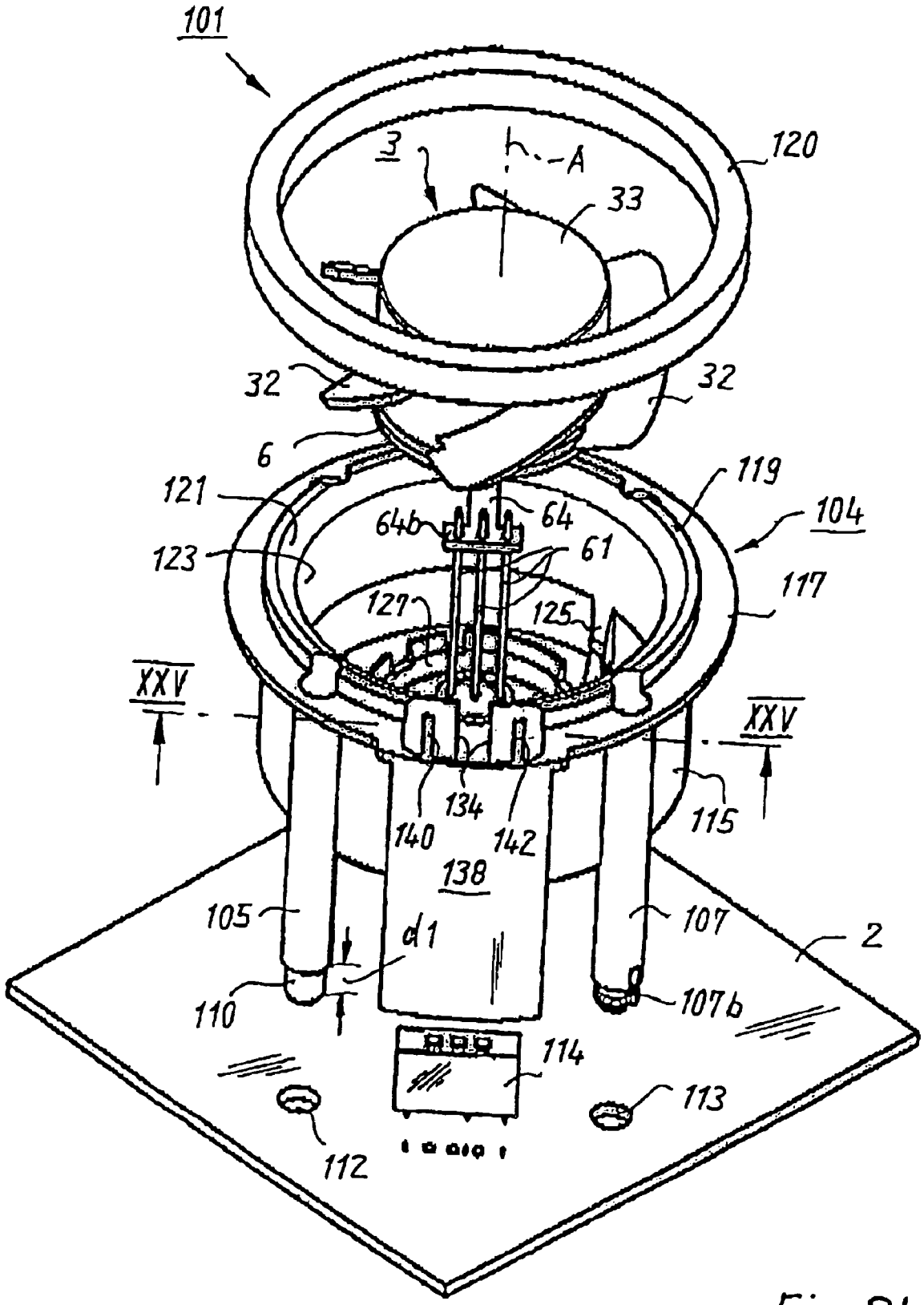
Figure 25:
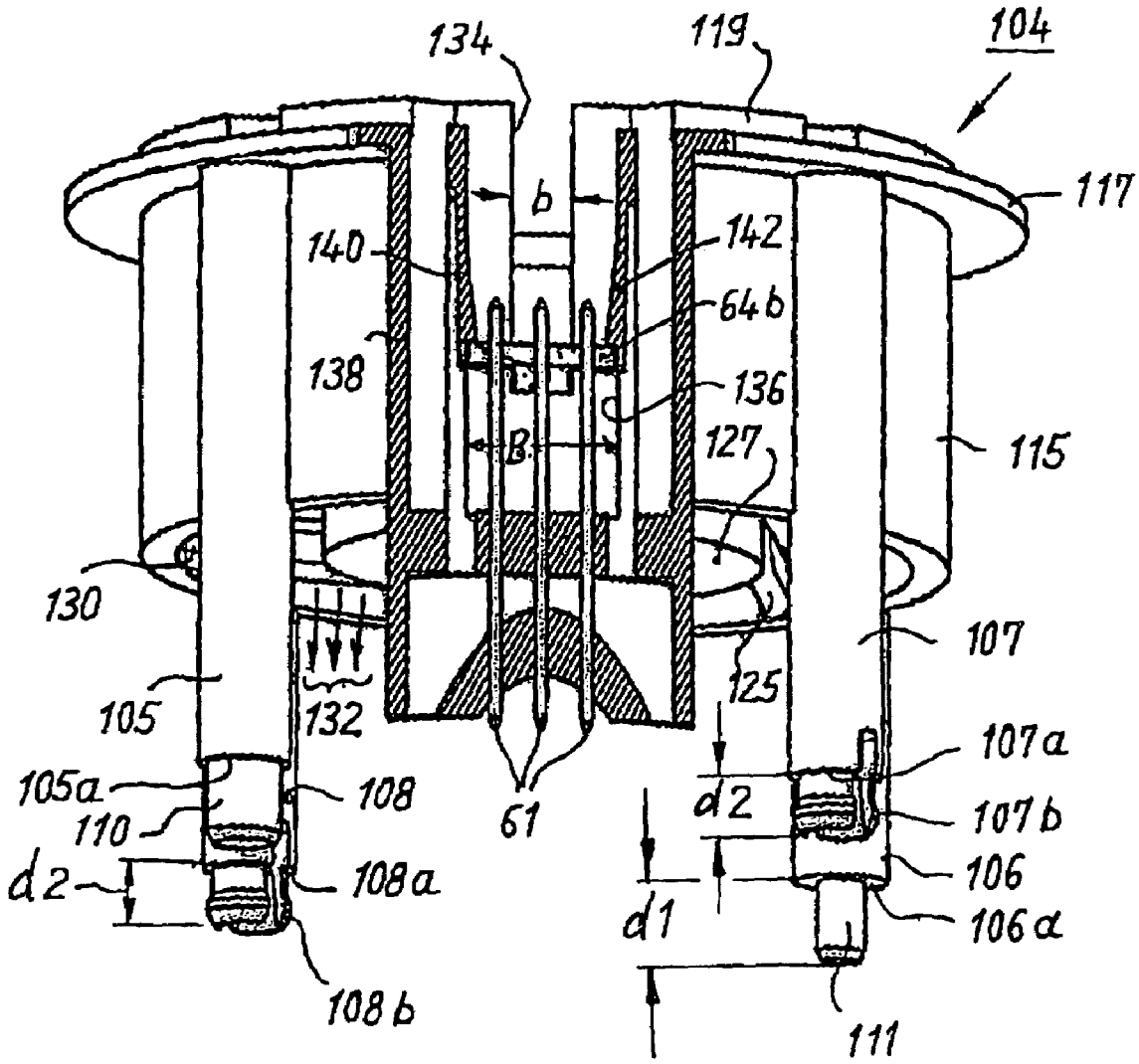

FIG. 24 is a greatly enlarged exploded depiction of another exemplifying embodiment of an arrangement according to the present invention, having a carrier frame and a miniature fan that is equipped with a circuit plate for electrical connection thereof and that is mounted, along with the circuit plate, on that carrier frame; and FIG. 25 is a three-dimensional depiction of the arrangement according to FIG. 24 in a partial section viewed along line XXV-XXV of FIG. 24, the circuit plate being depicted in its installed state but without the fan.

DETAILED DESCRIPTION

Identical reference characters in the Figures designate identical or identically functioning elements. Terms such as "above," "below," "left," and "right" refer to the respective Figure.

Figure 1:
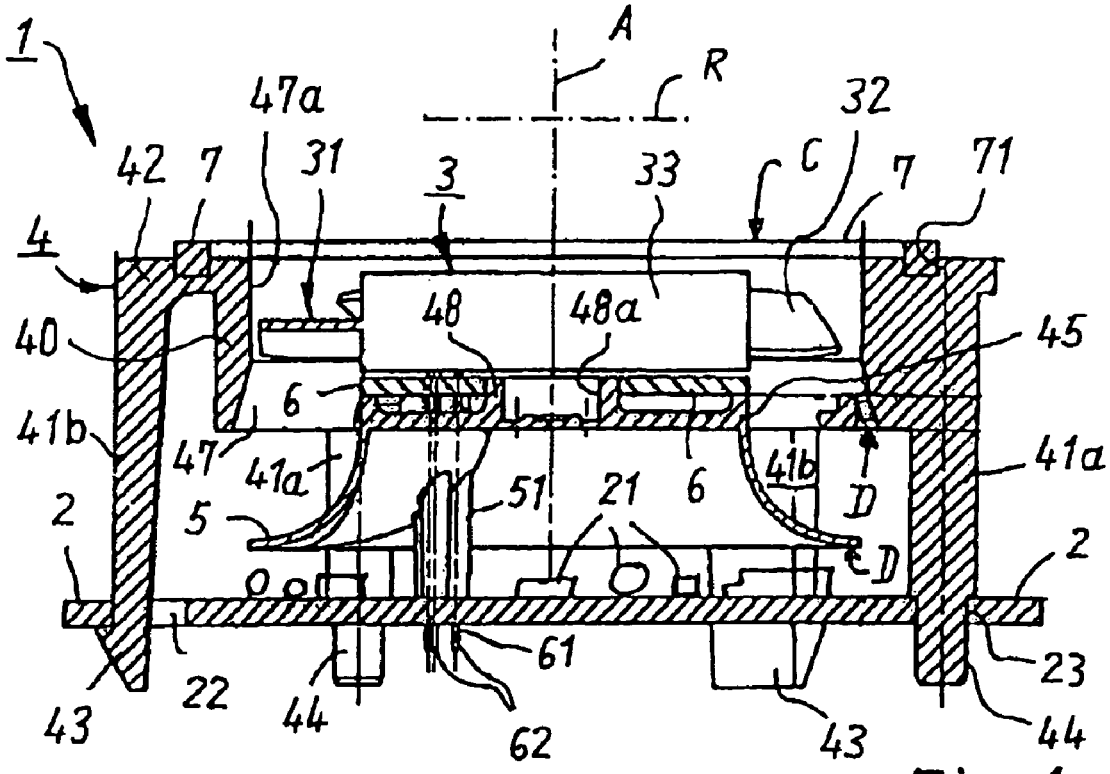
FIG. 1 is a schematic section through an arrangement according to the present invention having a carrier frame, a miniature fan mounted thereon, and an air-directing element for deflecting the air flow generated by the fan.
Figure 8:
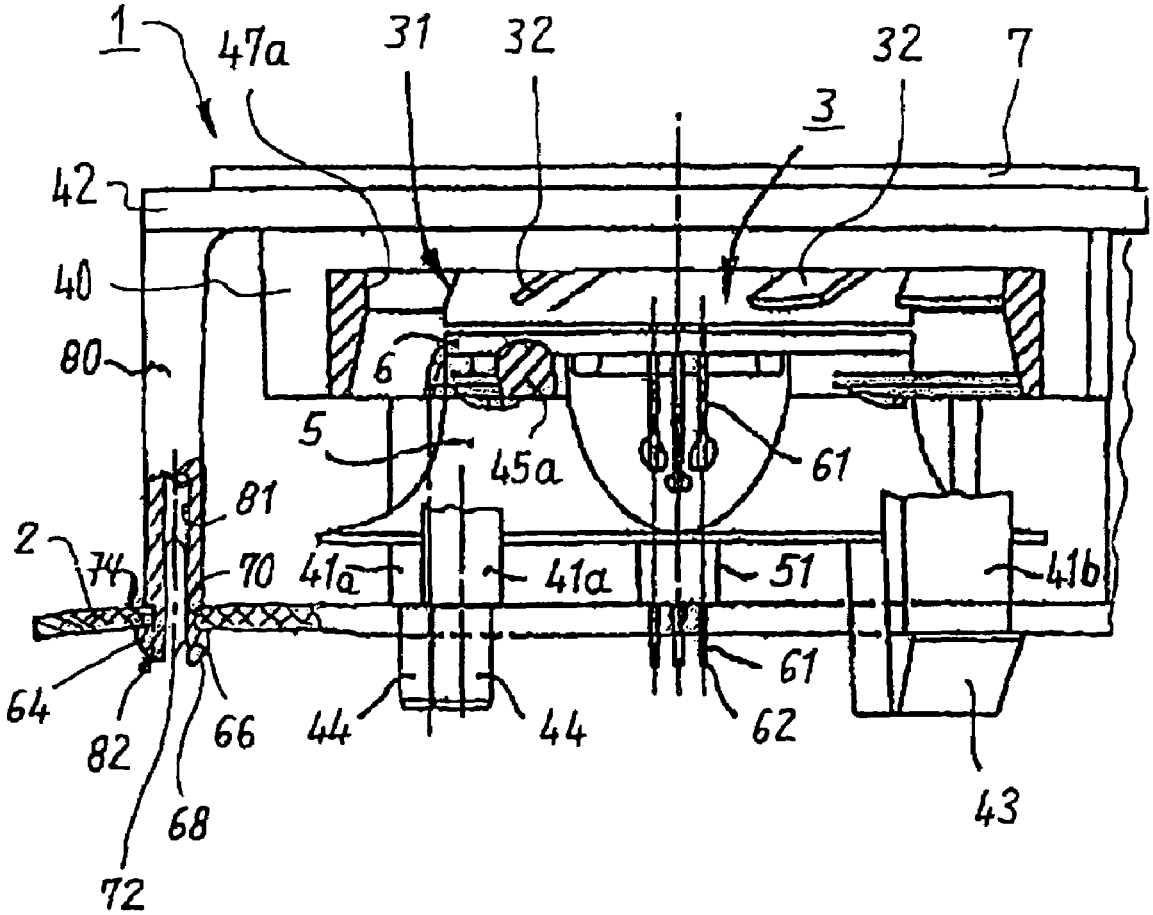
FIG. 8 shows a variant of FIG. 3 in which, instead of a latching hook, a round double spring is used which has an annular groove that is latched into a round orifice 70 of circuit board 2.

FIG. 1 is a schematic longitudinal section through an arrangement 1 according to the present invention. That arrangement has as its principal constituents a fan 3 having a fan wheel 31 whose fan blades are depicted at 32, and having an electric motor 33 to drive fan wheel 31. Arrangement 1 furthermore has a carrier frame 4 which carries fan 3 and on which the latter is mounted. Support elements 41*a* and latching elements 41*b* are shaped onto carrier frame 4. By means of latching elements 41*b*, carrier frame 4 can be mounted on a circuit board 2 by being clipped in. Components 21 that are to be cooled are depicted schematically on circuit board 2. FIG. 8 shows an alternative, preferred manner of mounting onto circuit board 2.

Fan 3 is arranged, with its fan wheel 31, in such a way that on its side C facing away from circuit board 2, it takes in an air flow having a direction substantially perpendicular to circuit board 2 (direction of rotation axis A of fan 3). At least a portion of this air flow is deflected, by an air-directing element 5 that is approximately bell-shaped, in such a way that this air flow proceeds approximately parallel to circuit board 2 and thereby optimally cools components 21.

Arrangement 1 thus performs multiple functions:

By means of latching elements 41*b* and support elements 41*a*, or latching feet 80 as shown in FIG. 8, it enables very rapid installation on circuit board 2.

It constitutes a spacing member that holds fan 3 at a desired distance from circuit board 2.

It constitutes an outer casing, namely a so-called venturi conduit, for blades 32 of fan 3, i.e. it completes fan 3 to form an equipment fan of ordinary design.

It shapes the air flow so as to optimize the cooling of components 21 on circuit board 2.

It reduces the area of circuit board 2, since components 21 can also be installed on circuit board 2 below arrangement 1, for example components that generate little heat, or components for which a portion of the air flow is diverted for cooling, as will be explained below with reference to FIGS. 9 to 23.

Ends 44 of support elements 41*a* serve to support arrangement 1 on circuit board 2. Latching elements 41*b* have, at their respective ends, a latching hook 43 for engagement behind an opening 22 in circuit board 2. Support elements 41*a* have a positioning extension 44 for retention at an associated complementary opening 23 of circuit 2. This makes possible simple, reversible installation of arrangement 1 on a circuit board 2. Electrical termination of electric motor 33 can be effected by soldering in a solder bath, together with the soldering of components 21. Electric motor 33 is electrically connected for this purpose, by means of a circuit plate 6, to wire connections 61. This allows the use of standard fans having standardized electrical terminals. Circuit plate 6 rests on a flange or support member 45 (which also carries fan 3) of carrier frame 4. Ends 62 of wire connections 61 are soldered, in the installed state, to conductors on circuit board 2.

Figure 5:
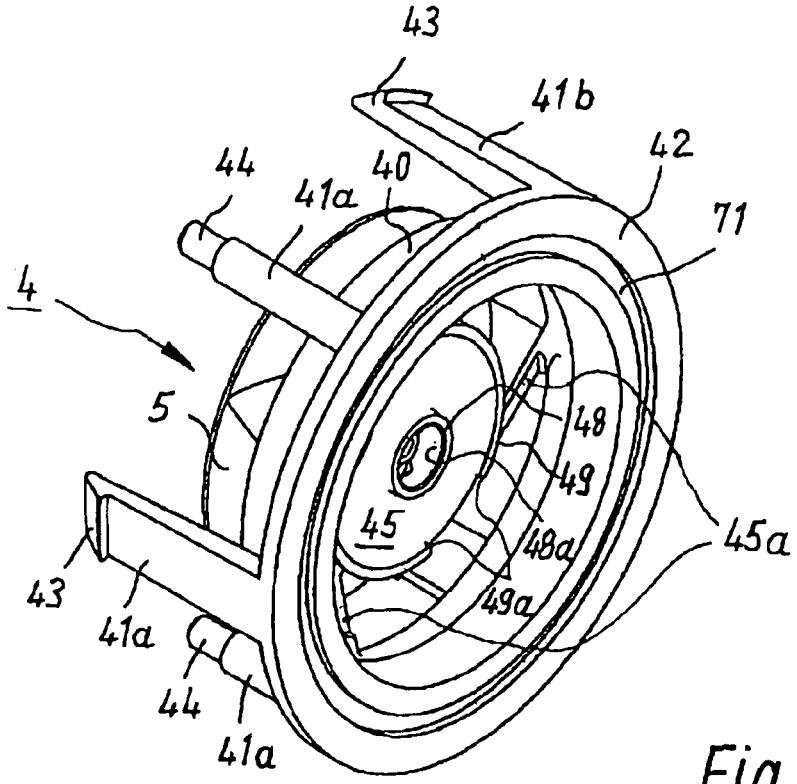
FIG. 5 is a three-dimensional depiction of a carrier frame and its air-directing member 5, but before installation of the miniature fan and viewed obliquely from above.
Figure 7:
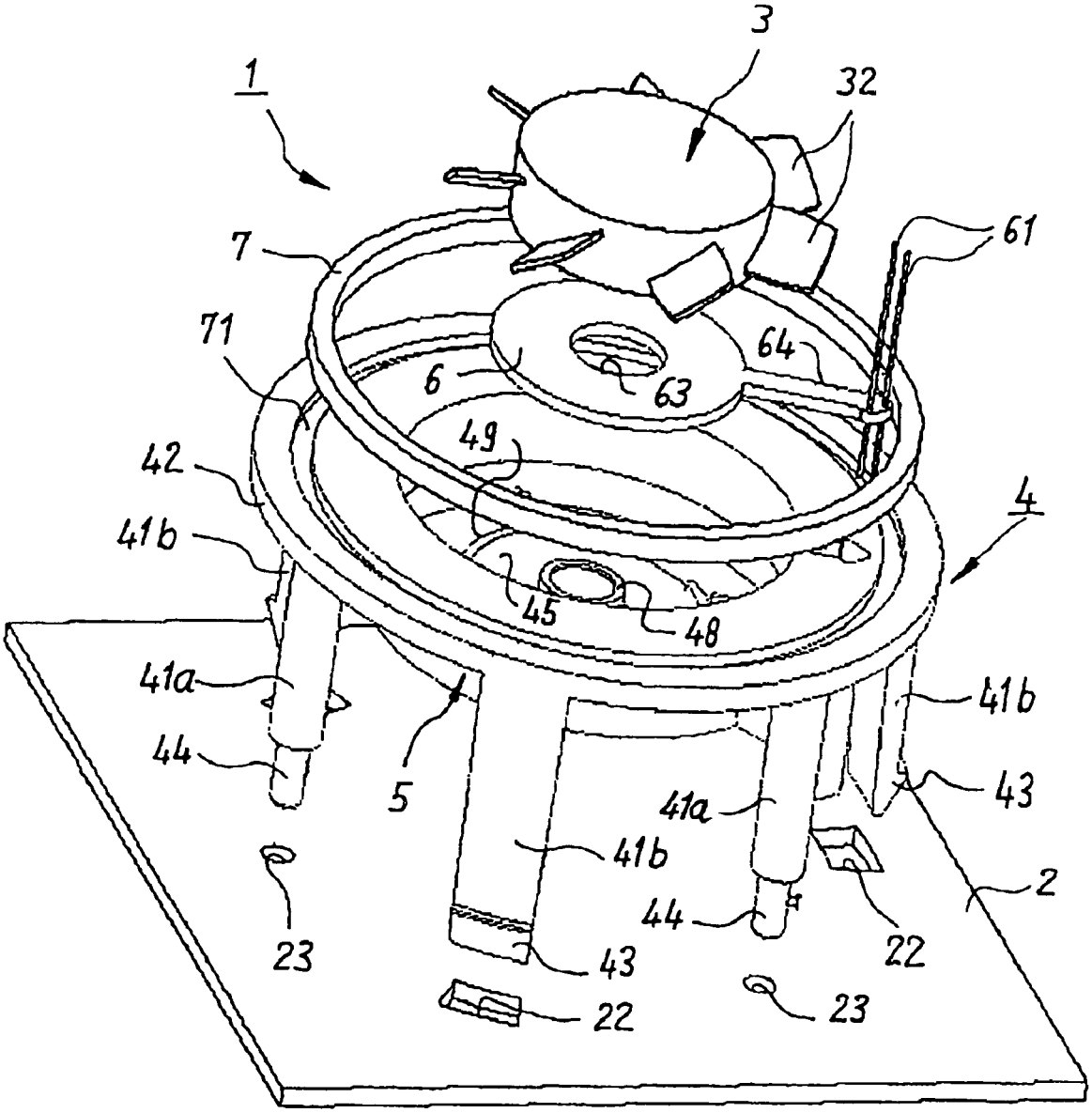
FIG. 7 is an exploded view of a circuit board, a carrier frame, a fan, and the electrical connection elements of that fan.

As FIG. 5 shows, support member 45 has an inner elevated rim 48 and an outer elevated rim 49 which serve to receive circuit plate 6. The latter has, as depicted in FIG. 7, a radially extending connecting part 64, and this part is guided radially outward through a cutout 49*a* (FIG. 5) of outer rim 49 and joined to vertically extending connecting leads 61. Opening 48*a* in inner rim 48 serves to mount motor 33 on support member 45.

As FIG. 8 shows, it is possible to use, for example, three connecting leads 61. The electronic components for motor 33, e.g. a Hall sensor and a commutation module, are located in circuit plate 6, and the latter therefore has a predetermined location relative to motor 33. Current is delivered to circuit plate 6 and to motor 33 via radial connecting part 64.

Figure 2:
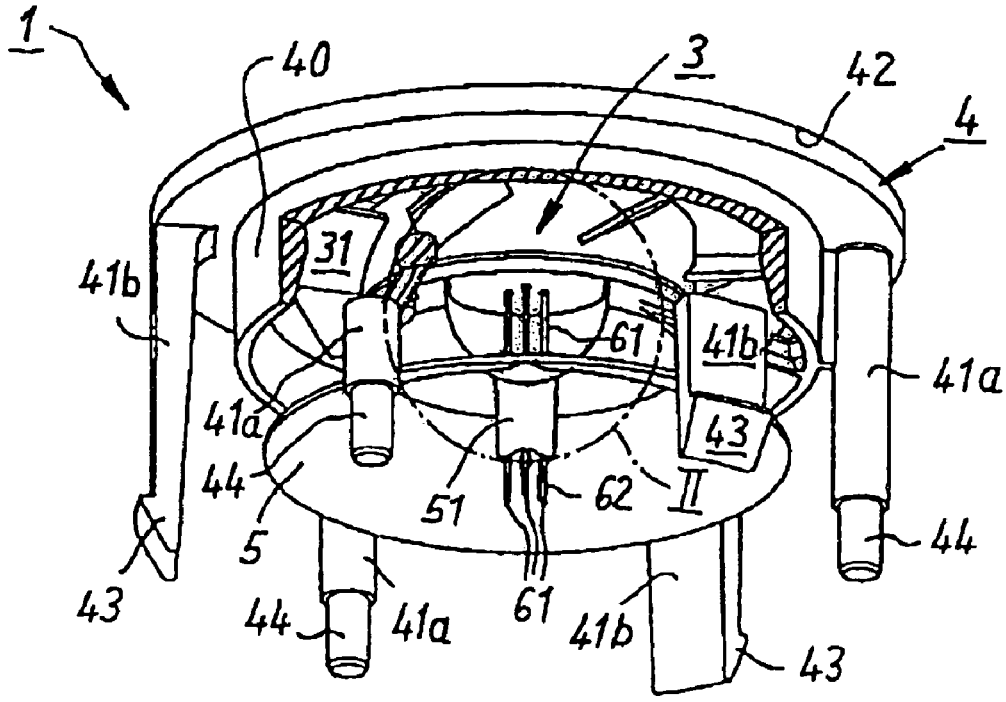
FIG. 2 is an oblique view from below of the fan of FIG. 1, with a partially sectioned depiction of the electrical connecting elements of the miniature fan.

It should be noted here that an electronically commutated subminiature fan has very small dimensions. A 250-series electronically commutated DC axial fan of ebm-papst, for example, has dimensions of 25×25×8 mm, a power consumption of 0.2 to 0.6 W, and weighs 8 g. The entire arrangement as depicted in FIGS. 1 and 2 can have, for example, a diameter of 55 mm and a height of 36 mm.

Leads 61 are partially surrounded, for their protection, by a sheath 51 that is implemented on carrier frame 4.

Arrangement 1 is implemented, on its side C facing away from circuit board 2, for contact against a housing wall or the like. To prevent rattling noises from occurring here, and in order to separate cold and hot air from one another, a sealing ring 7 is provided which is arranged in an annular groove 71 of an end portion 42 of carrier frame 4.

FIG. 5 is an oblique view from above of an as-yet uninstalled carrier frame 4, in which fan 3, circuit plate 6, wire connection 61, and sealing ring 7 are not depicted.

Support member 45 is shaped onto carrier frame 4 via struts 45*a*. Support members 41*a* and latching members 41*b*, which are fabricated from plastic together with carrier frame 4 and are equipped at their ends with latching extensions 43, are elastically resilient so that they can latch into place behind edges or apertures in or on circuit board 2.

Also provided on carrier frame 4 is an air flow-directing member 5 for controlled deflection of the air flow generated by fan 3.

Fan wheel 31 is located, in FIG. 1, above a ring-like air passthrough aperture 47 whose outer periphery 47*a*, often also called a "venturi," is constituted by an annular element 40 of carrier frame 4. Outer periphery 47*a* widens toward the bottom. Air flow-directing member 5 is arranged below air passthrough aperture 47, in such a way that it deflects the generated air flow in a direction approximately parallel to circuit board 2. Air flow-directing member 5 is preferably implemented integrally with carrier frame 4, and is shaped on below support member 45.

In order to shape the air flow in a direction parallel to circuit board 2, air-directing member 5 preferably has approximately the shape of a bell that widens in a radial direction R toward the bottom. It can therefore also be referred to as an air-directing bell 5.

Figure 4:
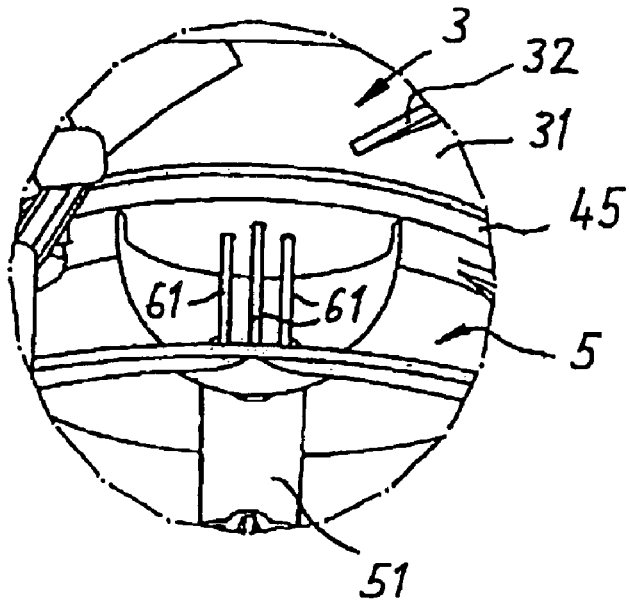
FIG. 4 depicts detail II of FIG. 2.

Sheath 51 for wire connections 61 is preferably implemented as a protuberance out of air flow-directing member 5. FIG. 2 shows this in an oblique view of arrangement 1 from below, specifically in a partially sectioned depiction looking at wire connections 61 and sheath 51. FIG. 4 is an enlarged depiction of region II of FIG. 2.

Figure 3:
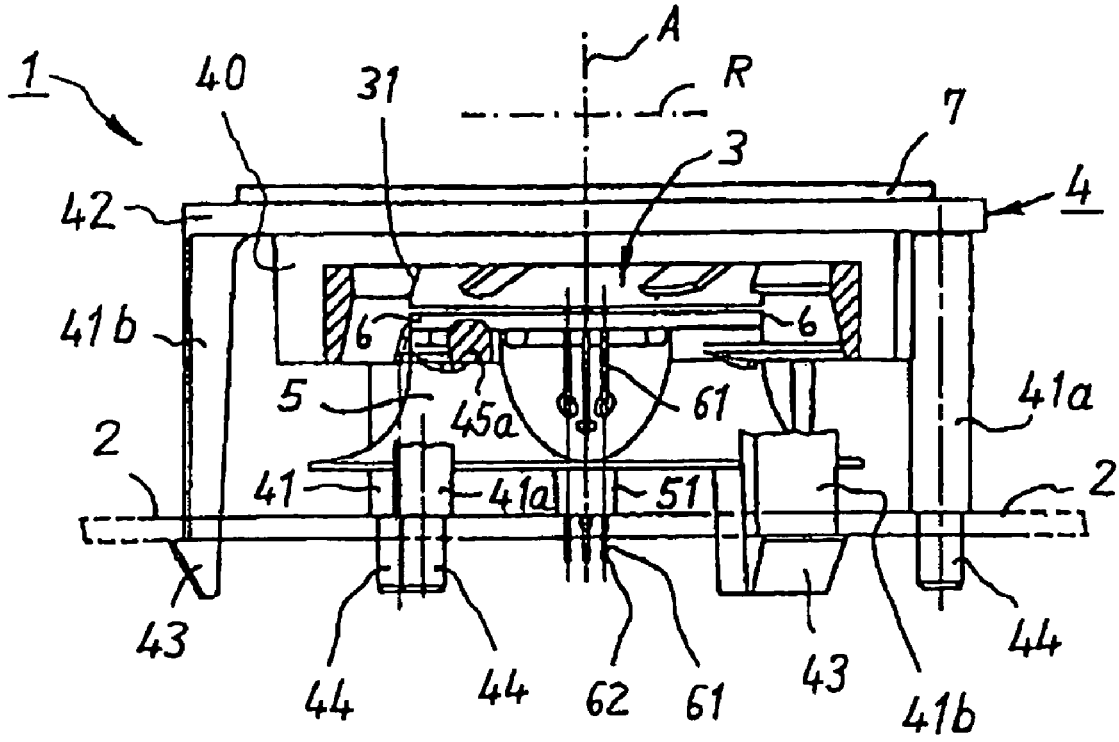
FIG. 3 is a partially sectioned side view of the arrangement according to FIGS. 1 and 2, depicted here after it has been installed on a circuit board.

FIG. 3 is a partially sectioned side view of arrangement 1. In this depiction, arrangement 1 is installed on a circuit board 2 by means of latching connections.

Carrier frame 4, having air flow-directing member 5 shaped onto it, is depicted in FIG. 5 in an oblique view from above in which fan 3, circuit plate 6, wire connections 61, and sealing ring 7 are not depicted.

Figure 6:
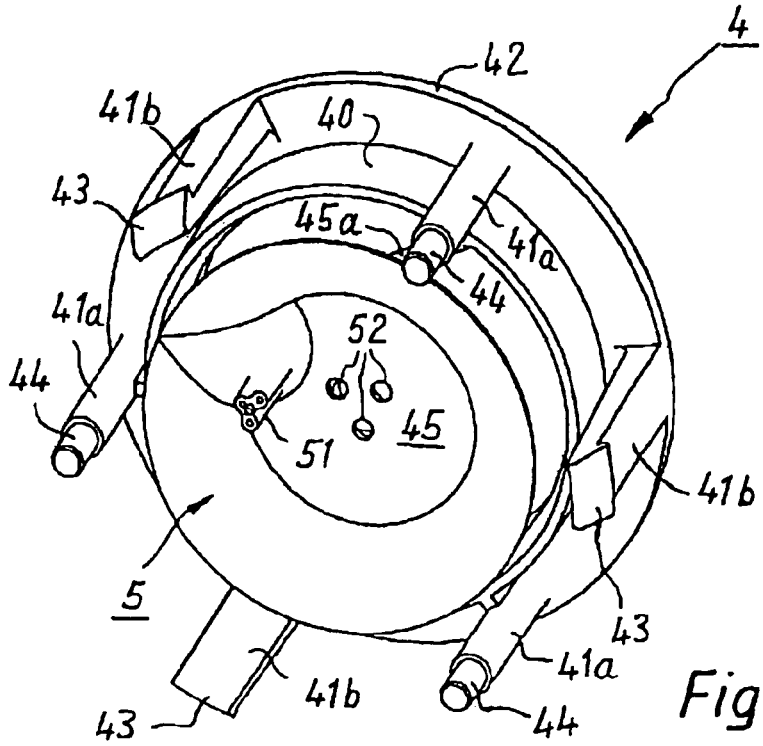
FIG. 6 is a three-dimensional depiction analogous to FIG. 5 but viewed from below, i.e. from the circuit-board side.

FIG. 6 is a view of carrier frame 4 from below, i.e. from the circuit-board side. Three holes 52, which serve for mounting motor 33, are evident in the center.

Arrangement 1 is preferably operated in such a way that cold air is drawn in from outside and delivered to the components that are to be cooled. Alternatively, fan 3 can also be operated in the opposite direction, so that it draws in heated air from circuit board 2 and blows it outward.

FIG. 7 is an exploded depiction of an arrangement 1 according to the present invention. Depicted at the bottom is circuit board 2, which has openings 23 for ends 44 of support members 41*a*, and openings 22 for latching hooks 43. The components on the circuit board are not depicted in FIG. 7.

Depicted above circuit board 2 is carrier frame 4, along with its associated sealing ring 7 and circuit plate 6. The latter is electrically connected, via its arm 64, to approximately vertically extending connecting leads 61.

Located above circuit plate 6 is fan 3 with its fan blades 32. It is mounted on support member (flange) 45 of carrier frame 4, preferably by way of a mechanical connection to central projection 48 of support member 45, which projection, in the installed state, penetrates through a central opening 63 of circuit plate 6 and thereby centers it.

FIG. 8 shows a preferred alternative to FIG. 3. What is provided here, instead of the flat latching hook 41*b* of FIG. 3, is a latching foot 80 having a cylindrical inner opening 81 extending in the longitudinal direction of that latching foot, and having a round double spring 82. The latter has two resilient limbs 64, 66, and tapers at the lower end to a cone 68 that facilitates insertion into a round hole 70 of circuit board 2. Limbs 64, 66 are formed by a longitudinal cut 72 in the lower end of latching foot 80. The latter has on its outer side an annular groove 74 that fits into opening 70 and, by being pressed into it, can be latched to it in positively engaging fashion. FIG. 8 shows this latched-in position.

A spring latching foot 80 of this kind thus enables installation by latching into a precisely defined position, so that support members 41*a* can be omitted.

FIGS. 9 to 23 show different variants of air-directing member 5 of FIGS. 1 to 8. This is because when electronic components 21 are located below this air-directing member, it may be necessary also to cool these components using a portion of the cooling air flow. FIGS. 9 to 23 each show an air-directing member 5, whose location on carrier frame 4 is evident from FIGS. 1 to 8 and which is joined to ring 40 of carrier frame 4 by (preferably three) struts 45*a* (FIG. 5). For simplicity's sake, these struts 45*a* are not depicted in FIGS. 9 to 23.

In the same fashion as in FIGS. 1 to 8, air-directing members 5 are arranged on carrier part (flange) 45 and are preferably integral with it. Inner elevated rim 48 and outer elevated rim 49 are located on the upper side of carrier part 45. Outer rim 49 usually has a cutout 49*a*, as depicted in FIG. 5. This cutout is not depicted in FIGS. 9 to 23, but can be provided there in the same fashion.

The outer side of air-directing member 5 generally has an upper portion 53 that extends substantially parallel to rotation axis A of fan 3. Portion 53 transitions, via a middle portion 54, into a lower portion 55 that extends approximately perpendicular to rotation axis A. These portions are depicted only in FIG. 9, and apply similarly to FIGS. 10 to 23.

Figure 9:
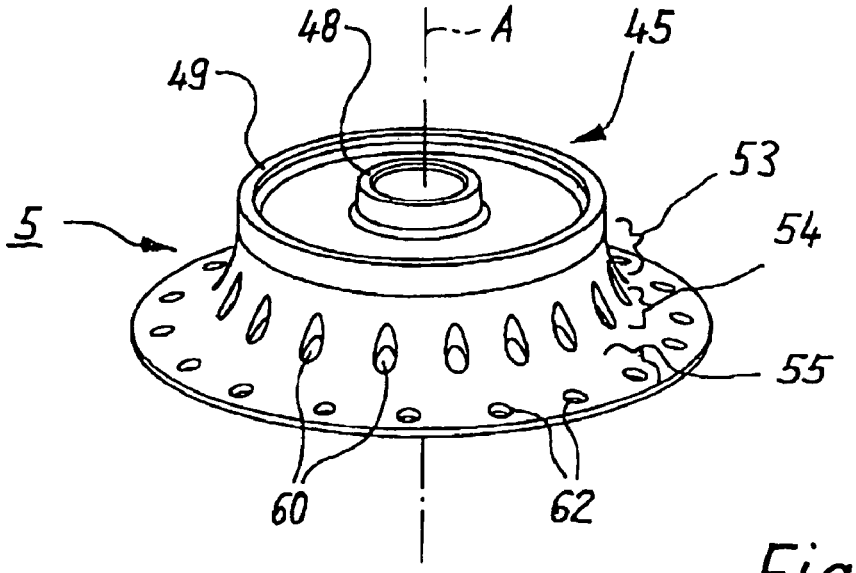
FIGS. 9 to 23 show different variants of the air-directing bell used in FIGS. 1 to 8; these variants enable even electronic components that are arranged directly below the carrier frame to be cooled with a predetermined portion of the cooling air flow generated by the miniature fan.

In FIG. 9, air-directing member 5 has a series of equidistant holes 60 having a circular cross section, which are located approximately at the transition from region 53 to region 54. Provided at an offset from these, on region 55, are an identical number of holes 62 likewise having a circular cross section.

Figure 10:
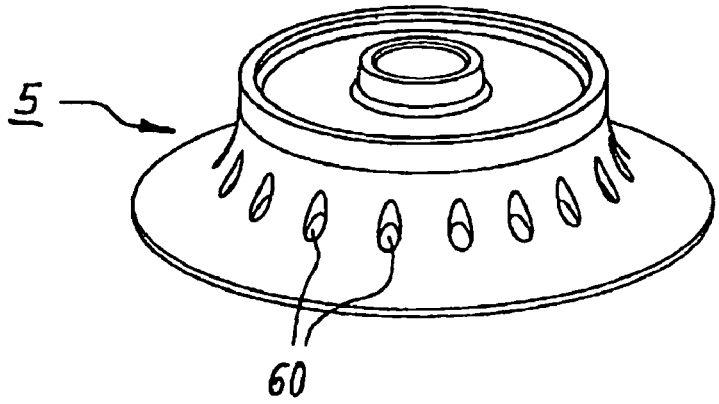

In this fashion, a relatively large quantity of air can flow under air-directing member 5 and have a cooling effect there. FIG. 10 largely corresponds to FIG. 9, but only holes 60, and not holes 62, are provided therein.

Figure 11:
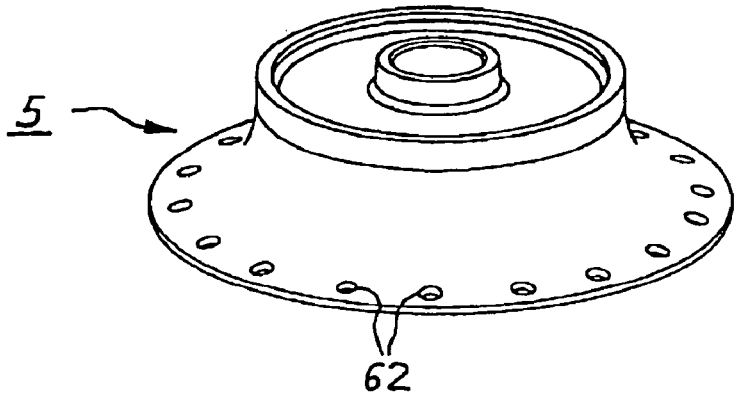

The opposite is true for FIG. 11, where only holes 62, but not holes 60, are provided. In both FIG. 10 and FIG. 11, therefore, the main cooling air flow to circuit board 2 is intensified.

Figure 12:
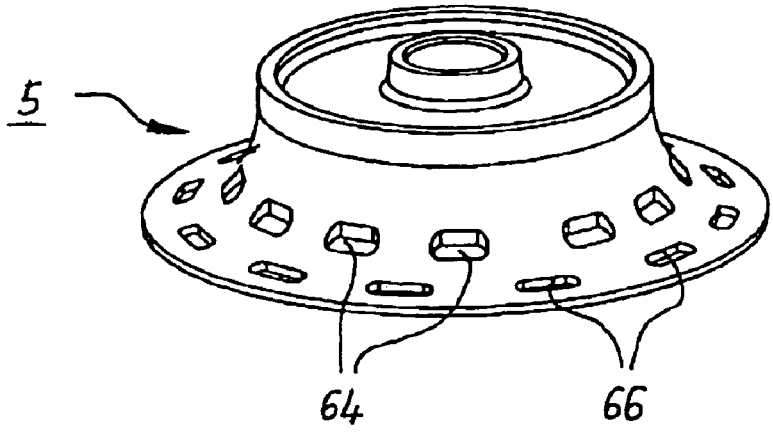

In FIG. 12, twelve elongated openings 64, which extend (as depicted) in the circumferential direction, are provided in transition region 54. Also provided in region 55 are twelve elongated openings 66 that likewise extend in the circumferential direction and are offset, in the manner depicted, relative to openings 64.

Figure 13:
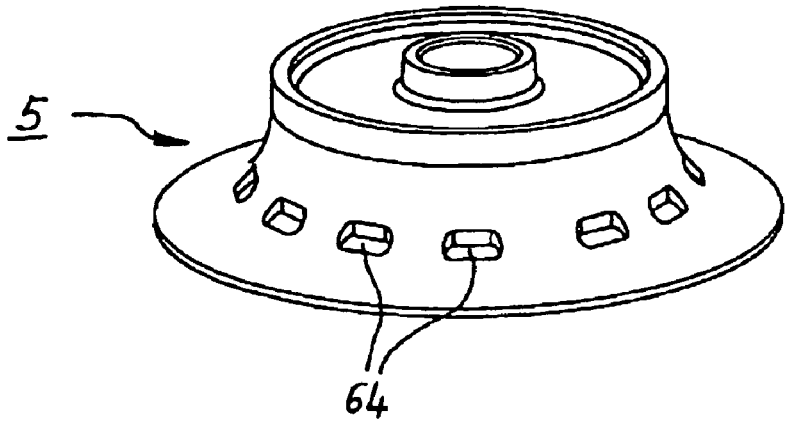
Figure 14:
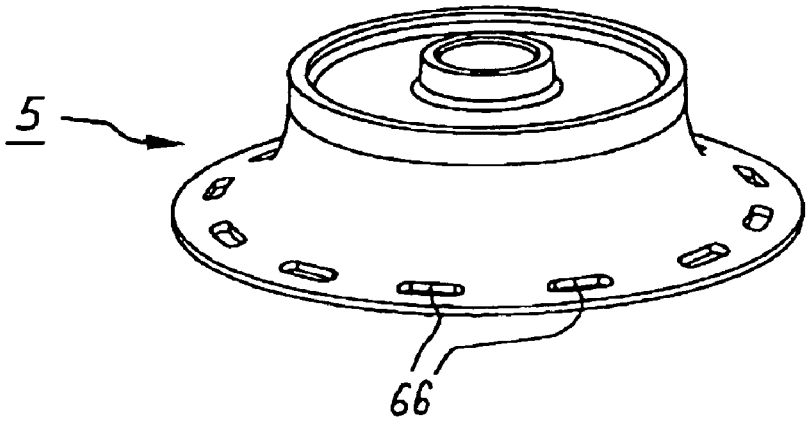

In the variant according to FIG. 13 only openings 64 are provided, and in the variant according to FIG. 14 only openings 66. Components below air-directing member 5 are therefore cooled most effectively in the context of FIG. 12, less strongly with FIG. 13, and least effectively with FIG. 14. The question as to which variant is used therefore depends substantially on how much heat is generated in the region below the respective air-directing member 5.

Figure 15:
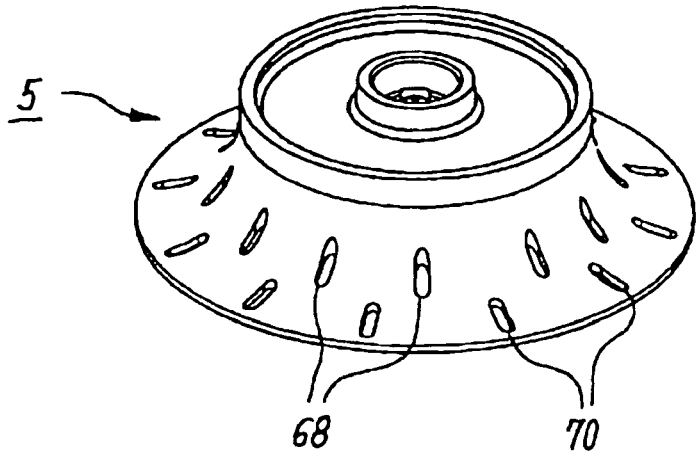

In FIG. 15, twelve elongated openings 68 that extend in the top-to-bottom direction are provided in transition region 54, and located between them in region 55 are twelve elongated openings 70 that likewise extend from top to bottom.

Figure 16:
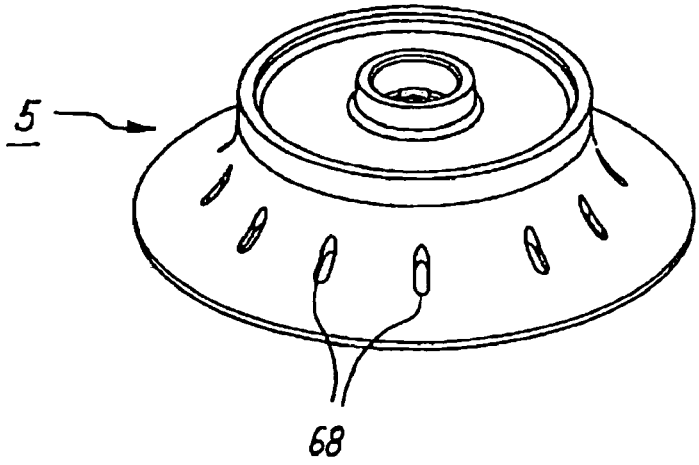
Figure 17:
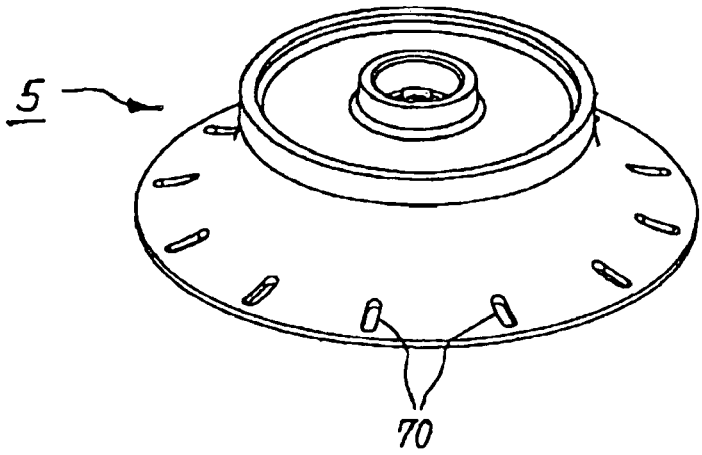

In FIG. 16, only openings 68 are present, and in FIG. 17 only openings 70. Here again, the cooling effect for components 21 below air-directing member 5 is best for FIG. 15, less good for FIG. 16, and worst for FIG. 17.

Figure 18:
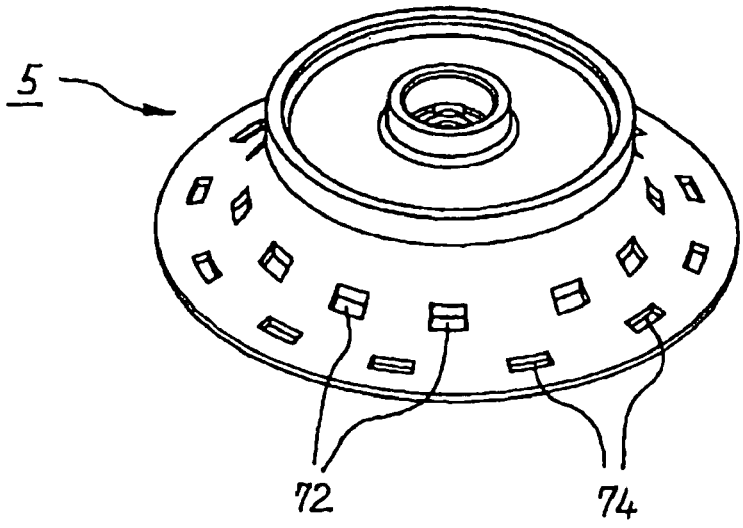

FIG. 18 shows an air-directing member 5 in which twelve openings 72 having a rectangular cross section are introduced into transition region 54. Twelve openings 74 having a rectangular cross section are likewise introduced into region 55, and these are offset with respect to openings 72.

Figure 19:
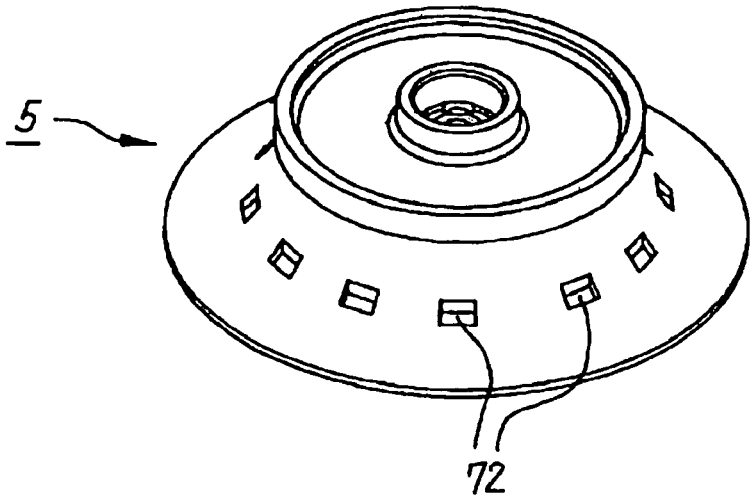
Figure 20:
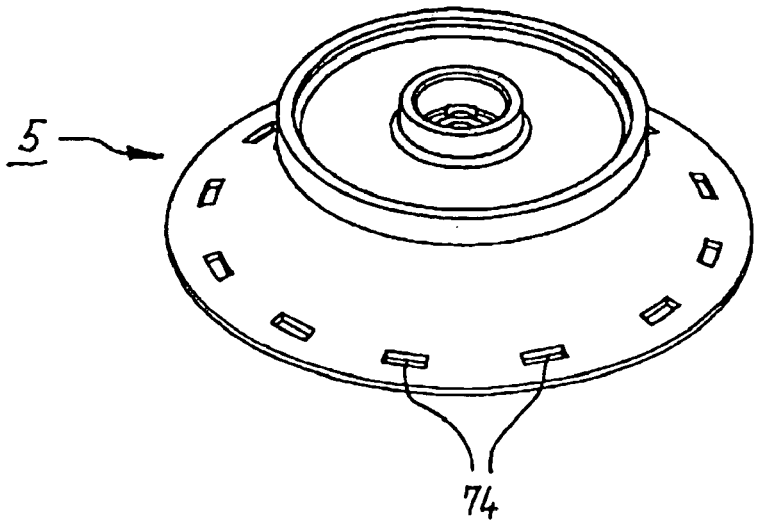

In FIG. 19, only openings 72 are present, and in FIG. 20 only openings 74. The cooling effect therefore decreases from FIG. 18 to FIG. 20.

Figure 21:
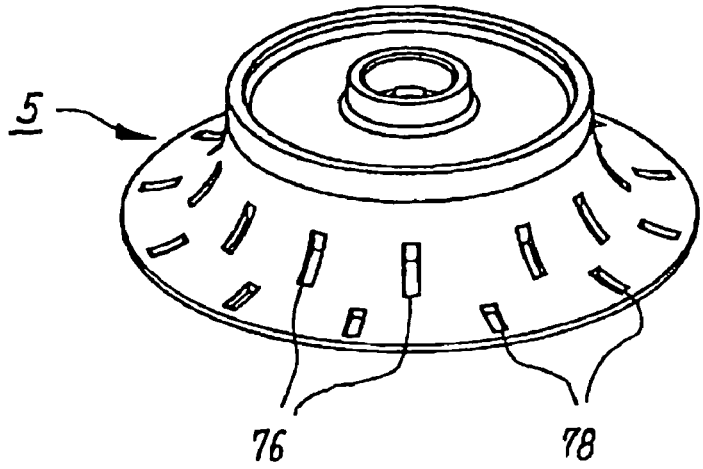
Figure 22:
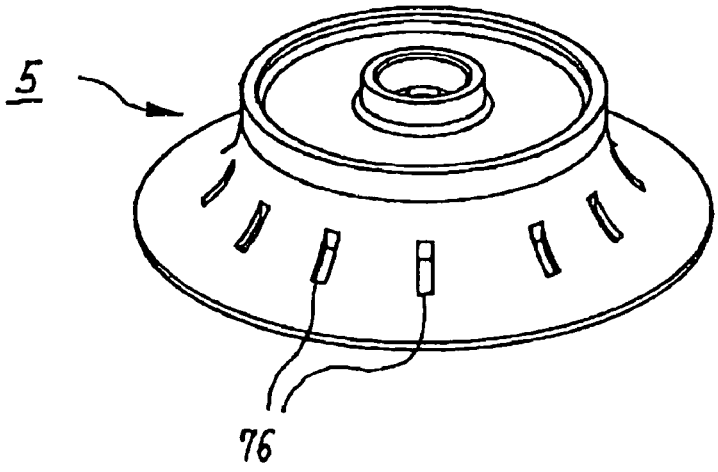
Figure 23:
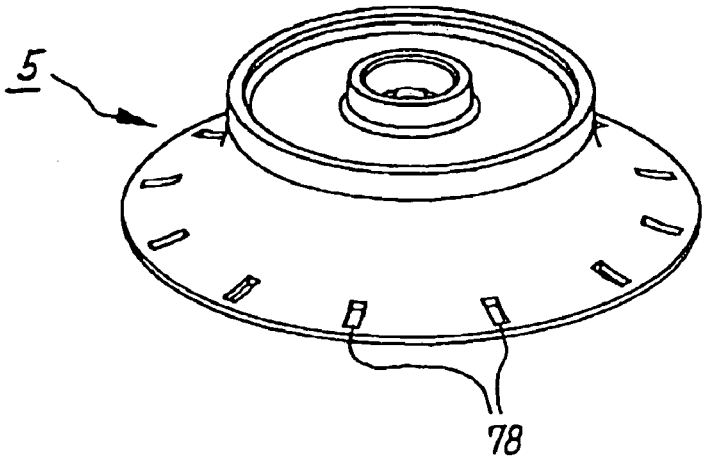

In FIG. 21, twelve openings 76 having a rectangular cross section are provided in transition region 54 of air-directing member 5, and twelve openings 78 likewise having a rectangular cross section are provided in region 55. In FIG. 22 only openings 76 are provided, and in FIG. 23 only openings 78. The manner of operation is practically the same as in the case of the variants according to FIGS. 15, 16, and 17; i.e. the cooling effect for components 21 below air-directing element 5 decreases from the variant according to FIG. 21 to the variant according to FIG. 23.

FIG. 24 shows another exemplifying embodiment of an arrangement 101 according to the present invention. As in the case of the previous exemplifying embodiments, the same reference characters are used for identical or identically functioning parts, and these parts are not described again. Arrangement 101 is installed, when it is used, on a circuit board 2 that is indicated in FIG. 24; and it preferably serves to cool a heat-sensitive component (not depicted in FIG. 24) that is mounted on circuit board 2 directly below arrangement 101. FIG. 1 shows components 21 of this kind.

Arrangement 101 has a carrier frame 104 that, as in the case of the previous exemplifying embodiments, is implemented approximately in the manner of an oil-drilling rig. It has four supporting legs, namely two guide legs 105, 106 and two latching legs 107, 108. The latter are implemented like spring latching foot 80 of FIG. 8, to the description of which the reader is therefore referred in the interest of brevity.

All the supporting legs 105 to 108 have a support surface 105*a*, 106, 107*a*, 108*a* with which they are supported, after installation, on the upper side of circuit board 2. Guide leg 105 has a guide peg 110 of length d1, and guide leg 106 likewise has a guide peg 111 of the same length d1 but with a smaller diameter. In the case of latching legs 107, 108, latching portions 107*b*, 108*b* have a length d2 that is less than d1.

Provided in corresponding fashion on circuit board 2 are four orifices, of which only two are visible in FIG. 24. One orifice 112 serves to receive guide peg 110, and one orifice 113 serves to receive latching leg 107, in the manner described in detail in the context of FIG. 8 for latching leg 80.

An orifice (not depicted) whose dimensions correspond to those of orifice 113 is provided for latching leg 108, and an orifice (not depicted) whose diameter is less than the diameter of orifice 112 is provided for guide leg 106.

Correct and also easy mounting of arrangement 101 on circuit board 2 is ensured in this fashion, since guide pegs 110, 111 must first be introduced into the corresponding orifices of circuit board 2, which is possible in only one specific rotational position; and only then is it even possible to latch latching portion 107*b* into orifice 113 and latching section 108*b* into the corresponding orifice (not depicted), since distances d1 are greater than distances d2.

Also installed on circuit board 2 is a plug connector 114 that serves for electrical connection of circuit board 2 to three metal pins 61, through which motor 33 of fan 3, or its connector plate 6, is electrically connected to corresponding conductor paths on circuit board 2.

The four supporting legs 105 to 108 are, as depicted, configured in hollow fashion and transition in their upper region into a substantially annular or tubular part 115 that transitions at the top into a flat rim 117 that extends perpendicular to rotation axis A and is delimited on its radially inner side by an upwardly projecting rim 119. A sealing ring 120 can be arranged on rim 117, and serves for sealing against a housing wall or the like. Rim 119 is shaped on its inner side 121 like a truncated cone. Truncated cone 121 transitions into a cylindrical portion 123 within which, during operation, blades 32 of fan 3 rotate.

Mounted at the lower end of cylindrical portion 123, by way of struts 125, is a carrier part 127, and located between it and cylindrical portion 123 is an annular air passthrough aperture 130 from which, during operation, a cooling air flow emerges downward as indicated symbolically at 132 in FIG. 25. (If applicable, the cooling air flow can also proceed in the opposite direction.)

As FIG. 25 shows, a groove-like gap 134, whose width b is matched to the width of arm 64 (FIG. 7) of circuit plate 6, is present in annular part 115, in flat rim 117, and in rim 119. This arm 64 widens at its free end into a hammer-like enlargement 64*b*, which is depicted in section in FIG. 25 and whose width B is greater than width b of groove 134. This enlargement 64*b* is guided in an opening 136, complementary to it, of a box-like expansion 138 of carrier frame 104, and is held there after installation by two latching springs 140, 142 in the manner shown in FIG. 25, so that circuit plate 6 is securely retained in the desired location after it is installed. This also ensures that the three metal pins 61 that are soldered in place on circuit plate 6 create contact with contact member 114 upon installation, and cannot be displaced upward in carrier frame 104.

Motor 33 is permanently joined, after its installation, to part 127, which is approximately saucer-shaped, in order to collect lubricating grease that might emerge from the bearings of motor 33 during operation, and to prevent contamination of circuit board 2.

Numerous variants and modifications are of course possible within the scope of the present invention.

The invention claimed is:

1. An arrangement for cooling a circuit board, comprising:

a generally flat carrier frame;

elements connecting said frame to the circuit board and supporting said frame thereon;

an annular air passthrough aperture; and a miniature fan that is mounted on a first side of the carrier frame facing away from the circuit board and at a distance from the circuit board, and is equipped with a fan wheel that, during operation, rotates about a rotation axis (A) and transports air through the annular air passthrough aperture, there being provided on the carrier frame, on the side of the air passthrough aperture facing toward the circuit board, an air-directing element which serves to deflect the flow direction of at least a portion of the air transported, during operation, through the air passthrough aperture, wherein the air-directing member is formed with penetrations in order to direct, through a wall of the air-directing member, a portion of the air flow delivered by the fan.

2. The arrangement according to claim 1, wherein the air-directing element is configured as a bell that widens in a radial direction away from the fan.

3. The arrangement according to claim 1, wherein the carrier frame comprises, radially inside the air passthrough aperture, a support member on which the fan is arranged.

4. The arrangement according to claim 3, wherein the support member (45) is joined, via struts (45*a*) to a part (40) of the carrier frame (4) located radially outside the air passthrough aperture (47).

5. The arrangement according to claim 4, wherein the part (40) of the carrier frame (4) located outside the air passthrough aperture (47) is configured as a tubular segment.

6. The arrangement according to claim 3, further comprising an electronically commutated motor (33) that is mounted on the support member (45) and coupled to drive the fan (3); and a circuit plate (6), which connects the motor (33) to electrical connecting leads (61), and is arranged between that motor (33) and the support member (45).

7. The arrangement according to claim 6, wherein the circuit plate (6) comprises electronic components for commutation of the motor (33) serving to drive the fan.

8. The arrangement according to claim 6, wherein the electrical connecting leads (62) are guided in the carrier frame (4), and are implemented at their circuit-board end (D) for electrical contacting with the circuit board (2).

9. The arrangement according to claim 8, wherein the connecting leads are implemented as wire connections (61) that are at least partially surrounded by a sheath (51).

10. The arrangement according to claim 5, wherein said fan includes a fan wheel (31) having an outer side which, together with an inner side (47*a*) of the part (40) implemented in the manner of a tubular segment, forms an annular space (47) inside which, during operation, the blades (32) of the fan wheel (31) rotate.

11. The arrangement according to claim 10, wherein the cross section of the annular space (47) widens in the direction toward its outlet.

12. The arrangement according to claim 1, wherein the carrier frame (4) comprises, on its side facing away from the circuit board, an end surface (42) on which a sealing ring (7) is arranged.

13. The arrangement according to claim 12, wherein a depression, inside which the fan (3) is arranged, is provided inside the end surface (42) of said carrier frame.

14. The arrangement according to claim 1, wherein the fan (3) is arranged to transport, through the air passthrough aperture (47), air coming from the air-directing element (5).

15. The arrangement according to claim 1, wherein the fan (3) is arranged to transport air through the air passthrough aperture (47) in a direction that goes from the air passthrough aperture (47) to the air-directing element (5), in order to deflect the air at that element in a direction away from the rotation axis (A) of the fan (3).

16. A carrier frame for installation of a fan at a predetermined distance from a circuit board, comprising:

a support member that, in an installed state, is at a distance from the circuit board and serves as a carrier for a motor of the fan, which support member is surrounded by an outer air-guiding member that is joined via at least one joining member to the support member, which joining member crosses the air flow passage;

installation elements being provided for installation of the carrier frame on the circuit board; and an air-directing member being provided on the support member on a side of the support member facing toward the circuit board, which air-directing member serves to deflect the flow direction of at least a portion of air transported, during operation of the fan, through the air flow passage, wherein the air-directing member is formed with at least one penetration that serves to direct, through a wall of the air-directing member, a portion of the air flow delivered by the fan.

17. The carrier frame according to claim 16, wherein the air-directing element (5) is shaped as a bell whose open side faces toward the circuit board (2).

18. The carrier frame according to claim 16, wherein the support member (45) is joined, via joining members (45*a*), to said air guiding member (40) located radially outside the air passthrough passage (47).

19. The carrier frame according to claim 18, wherein the air guiding member (40) located outside the air passthrough passage (47) is formed as a tubular segment.

20. The carrier frame according to claim 16, further comprising an electronically commutated motor (33) mounted on the support member (45) in order to drive the fan (3).

21. The carrier frame according to claim 20, wherein a circuit plate (6), adapted to connect the motor (33) to electrical connecting leads (61), is arranged between that motor (33) and the support member (45).

22. The carrier frame according to claim 21, wherein the circuit plate (6) comprises electronic components for commutation of the motor (33).

23. The carrier frame according to claim 21, in which the electrical connecting leads (62) are guided inside the frame, which leads are formed at their circuit-board ends with terminals (D) for electrical contact with the circuit board (2).

24. The carrier frame according to claim 23, wherein the connecting leads are implemented as wire connections (61) that are at least partially surrounded by a sheath (51).

25. The carrier frame according to claims 19, wherein an outer side of the fan wheel (31) forms, together with an inner side (47*a*) of the part (40) configured as a tube section, an annular space (47) inside which, during operation, the blades (32) of the fan wheel (31) rotate.

26. The carrier frame according to claim 25, wherein the cross section of the annular space (47) widens adjacent at least one end portion.

27. The carrier frame according to any of claim 16, wherein the frame has a side facing away from the circuit board (2), defining an end surface (42) on which a sealing ring (7) is arranged.

28. The carrier frame according to claim 27, wherein a depression for receiving a fan (3) is formed inside the end surface (42).

* * * * *

UNITED STATES PATENT AND TRADEMARK OFFICE

CERTIFICATE OF CORRECTION

PATENT NO. : 7,390,172 B2
APPLICATION NO. : 10/574988
DATED : June 24, 2008
INVENTOR(S) : Wolfgang Arno Winkler It is certified that error appears in the above-identified patent and that said Letters Patent is hereby corrected as shown below:

1. In column 10, line 15, claim 25, line 1, “claims” should be --claim--.

2. In column 10, line 23, claim 27, line 1, “any of” should be deleted.

Signed and Sealed this

Thirtieth Day of September, 2008

JON W. DUDAS
*Director of the United States Patent and Trademark Office*